US007915552B2

(12) United States Patent
Kim

(10) Patent No.: US 7,915,552 B2
(45) Date of Patent: Mar. 29, 2011

(54) CONTROL PANEL ASSEMBLY AND METHOD FOR CONTROLLING THEREOF

(75) Inventor: Jae Mun Kim, Jinhae-si (KR)

(73) Assignee: LG Electronics Inc., Seoul (KR)

( * ) Notice: Subject to any disclaimer, the term of this patent is extended or adjusted under 35 U.S.C. 154(b) by 336 days.

(21) Appl. No.: 12/153,819

(22) Filed: May 23, 2008

(65) Prior Publication Data

US 2008/0232087 A1 Sep. 25, 2008

Related U.S. Application Data

(62) Division of application No. 10/925,039, filed on Aug. 25, 2004, now Pat. No. 7,394,033.

(30) Foreign Application Priority Data

Aug. 26, 2003 (KR) ..... 10-2003-0059108
Aug. 26, 2003 (KR) ..... 10-2003-0059112
Oct. 17, 2003 (KR) ..... 10-2003-0072465

(51) Int. Cl.
*H01H 9/16* (2006.01)

(52) U.S. Cl. ..... 200/310; 200/317; 200/296

(58) Field of Classification Search ..... 200/296, 200/310–317; 341/22, 23, 28; 345/168–170; 362/249.02, 253, 324, 29, 311.01, 555, 27, 362/30, 23; 340/815.45, 815.47, 815.55
See application file for complete search history.

(56) References Cited

U.S. PATENT DOCUMENTS 3,717,117 A * 2/1973 Stanley ..... 340/815.49
3,968,336 A 7/1976 Johnson
4,126,855 A * 11/1978 Alms et al. ..... 340/815.47
5,252,798 A 10/1993 Kamada
5,280,145 A 1/1994 Mosier et al.
5,285,037 A 2/1994 Baranski et al.
5,464,955 A * 11/1995 Cole ..... 200/317
5,673,995 A * 10/1997 Segaud ..... 362/545
5,697,689 A * 12/1997 Levine et al. ..... 362/26
5,713,655 A 2/1998 Blackman
5,874,901 A * 2/1999 Ohyama ..... 340/815.42
6,344,622 B1 2/2002 Takiguchi et al.
6,367,940 B1 * 4/2002 Parker et al. ..... 362/29
6,652,128 B2 * 11/2003 Misaras ..... 362/488
6,844,509 B2 1/2005 Tsuchiya et al.
7,091,434 B2 * 8/2006 Suzuki ..... 200/316
7,673,997 B2 * 3/2010 Hwang et al. ..... 362/27
2003/0055648 A1 3/2003 Cragun

FOREIGN PATENT DOCUMENTS

CN 1093827 A 10/1994

(Continued)

*Primary Examiner* — Michael A Friedhofer

(74) *Attorney, Agent, or Firm* — McKenna Long & Aldridge LLP

(57) ABSTRACT

A control panel assembly is disclosed for making it easy to manipulate buttons of home appliances, the control panel including at least one LED connected to a circuit board for selectively emitting light, a switch connected to the circuit board and provided adjacent to the LED for controlling a home appliance, a control panel provided in front of the LED and having at least one first hole, and at least one elastic button coupled with an edge of the first hole for selectively coming into contact with the switch in response to a user pressing the button, the elastic button having a pushing member including a first light-transmitting part for transmitting therethrough light emitted from the LED.

8 Claims, 10 Drawing Sheets

FOREIGN PATENT DOCUMENTS

| | | | |
|---|---|---|---|
| DE | 10216038 | C1 | 5/2003 |
| EP | 0575767 | A1 | 12/1993 |
| EP | 1176619 | A2 | 1/2002 |
| JP | 2001-162092 | | 6/2001 |

* cited by examiner

CONTROL PANEL ASSEMBLY AND METHOD FOR CONTROLLING THEREOF

CROSS-REFERENCE TO RELATED APPLICATIONS

This application is a Divisional of application Ser. No. 10/925,039, filed on Aug. 25, 2004, now U.S. Pat. No. 7,394,033 and claims the benefit of Korean Patent Application No. P2003-59112 and P2003-59108 filed on Aug. 26, 2003, and Korean Application No. P2003-72465 filed on Oct. 17, 2003, which are hereby incorporated by reference as if fully set forth herein.

BACKGROUND OF THE INVENTION

1. Field of the Invention

The present invention relates to a control panel of a home appliance, and more particularly, to a control panel assembly having an improved structure.

2. Discussion of the Related Art

In general, on a front surface of an electric home appliance such as a washing machine, a control panel is provided for controlling the home appliance. FIG. 1 illustrates a perspective view showing a conventional washing machine and FIG. 2 illustrates a front view showing the control panel.

As illustrated in FIG. 1, a control panel 2 is provided in an upper front part of a main body 1 of the washing machine for a user to control the washing machine. In this case, a drum is rotatably provided therein for receiving laundries. The drum receives driving force of the motor to rotate. At this time, washing is performed by a fraction between a water current and laundries, and a chemical action of a detergent.

Meanwhile, the control panel includes a display for displaying operating states of various kinds of buttons and the home appliance. As illustrated in FIG. 2, the control panel 2 includes a plurality of holes 2*a* through which the buttons 30 pass, and a power button 35, an operation button 33, a selecting button 31 are inserted into each of the plurality of holes 2*a*. In the rear of the control panel 2, a circuit board is provided, and switches are provided at locations corresponding to each of the buttons 30 for controlling operation of the washing machine. Accordingly, the switch located in the rear of the button is pressed when the user presses the button 30. When the switch is pressed, a signal is sent to a micom (not shown) and an operation state of the washing machine is controlled by the micom.

However, the control panel above mentioned has problems as follows. The control panel is hard to be distinguished by a naked eye at night, thus the user needs to use a separate lighting apparatus for preventing the washing machine from malfunctioning caused by the user mistakenly pressing the button. In addition, it is difficult for the user to know the operation state of the washing machine at night.

SUMMARY OF THE INVENTION

Accordingly, the present invention is directed to a control panel assembly for making it easy to manipulate at night without a separate lighting apparatus that substantially obviates one or more problems due to limitations and disadvantages of the related art.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a control panel assembly is disclosed for making it easy to manipulate buttons of home appliances, the control panel including at least one LED connected to a circuit board for selectively emitting light, a switch connected to the circuit board and provided adjacent to the LED for controlling a home appliance, a control panel provided in front of the LED and having at least one first hole, and at least one elastic button coupled with an edge of the first hole for selectively coming into contact with the switch in response to a user pressing the button, the elastic button having a pushing member including a first light-transmitting part for transmitting therethrough light emitted from the LED.

The control panel assembly further includes a main frame, and a supporter including at least one protecting member provided at the frame for inserting the LED therein. The protecting button is formed in a cylindrical shape and includes a second hole formed toward the control panel. The elastic button further comprises a pushing member including a transmitting member for transmitting light emitted from the LED, and an elastic supporting member extended outwardly from the edge of the pushing member and coupled with the edge of the first hole.

The elastic supporting member comprises a thin holes formed therein in a 'U' shape for increasing elasticity. A protrusion selectively coming into contact with the switch is provided at a bottom surface of the elastic button.

A stopper provided near to the switch for maintaining the balance of the elastic button when the elastic button is in contact with the switch. The height of the stopper is lower than that of the switch. The switch is a contact switch being operated by the contact with the elastic button.

The control panel assembly further includes an approach detecting sensor; and a control means for selectively supplying electric power to the LED when the sensor detects an approach of the user.

A hook is provided on an inside edge of the first hole and is snap fitted in a fixing groove formed in an edge of the elastic button. The control panel includes at least one second hole formed at the control panel, and at least one auxiliary LED is provided at a lower part of the second hole for displaying the operation state of the home appliance.

The LED window includes a body; and a plurality of second light-transmitting members provided in a plurality of the third holes, the second light-transmitting members being branched from the body respectively so as to correspond to each of a plurality of the auxiliary LEDs.

The second light-transmitting members are provided at predetermined intervals from each other. The second light-transmitting members have a display member forwardly projected, and the display member is inserted into the first hole. A projection rib is provided on an inside surface of the control panel, and the projection rib is coupled to a coupling hole formed at one side of the body.

The supporter comprises a main frame; and at least one protecting member provided in the main frame for inserting the LED therein. The protecting member is formed in a cylindrical shape and has a second hole toward the control panel.

The control panel assembly further includes an approach detecting sensor; and control means for selectively supplying electric power to the LED when the sensor detects an approach of the user.

The control panel assembly further includes a switch connected to the circuit board and provided at a side of the supporter for manipulating a home appliance; and At least one elastic button coupled with an edge of the first hole for selectively coming into contact with the switch in response to a user pressing the button, wherein the elastic member comprises a pushing member including a first light-transmitting part for transmitting therethrough light emitted from the LED In another aspect of the present invention, a method for controlling a control panel assembly comprising a plurality of LEDs connected to a circuit board for selectively emitting light; a plurality of switches connected to the circuit board and provided adjacent to each of the LEDs respectively for controlling a home appliance; a control panel provided in front of the LEDs and having a plurality of first holes; and a power button and an operation button provided at an edge of the first hole respectively, and each button selectively coming into contact with the switch in response to a user pressing thereon and being lighted, wherein the control method for the control panel assembly includes a first step for pressing the power button so as to supply electric power to the home appliance; a second step for lighting the power button; a second step for blinking the operation button; and a fourth step for pressing the operation button so as to operate the home appliance.

The fourth step further includes a step for lighting both the power button and the operation button.

The fourth step may further include a step for turning off light of both the power button and the operation button. The fourth step may include a step for turning off light of the power button and lighting the operation button.

The first step includes a step for automatically supplying electric power to the home appliance and lighting the power button when an approach detecting sensor provided in the home appliance detects an approach of a user.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
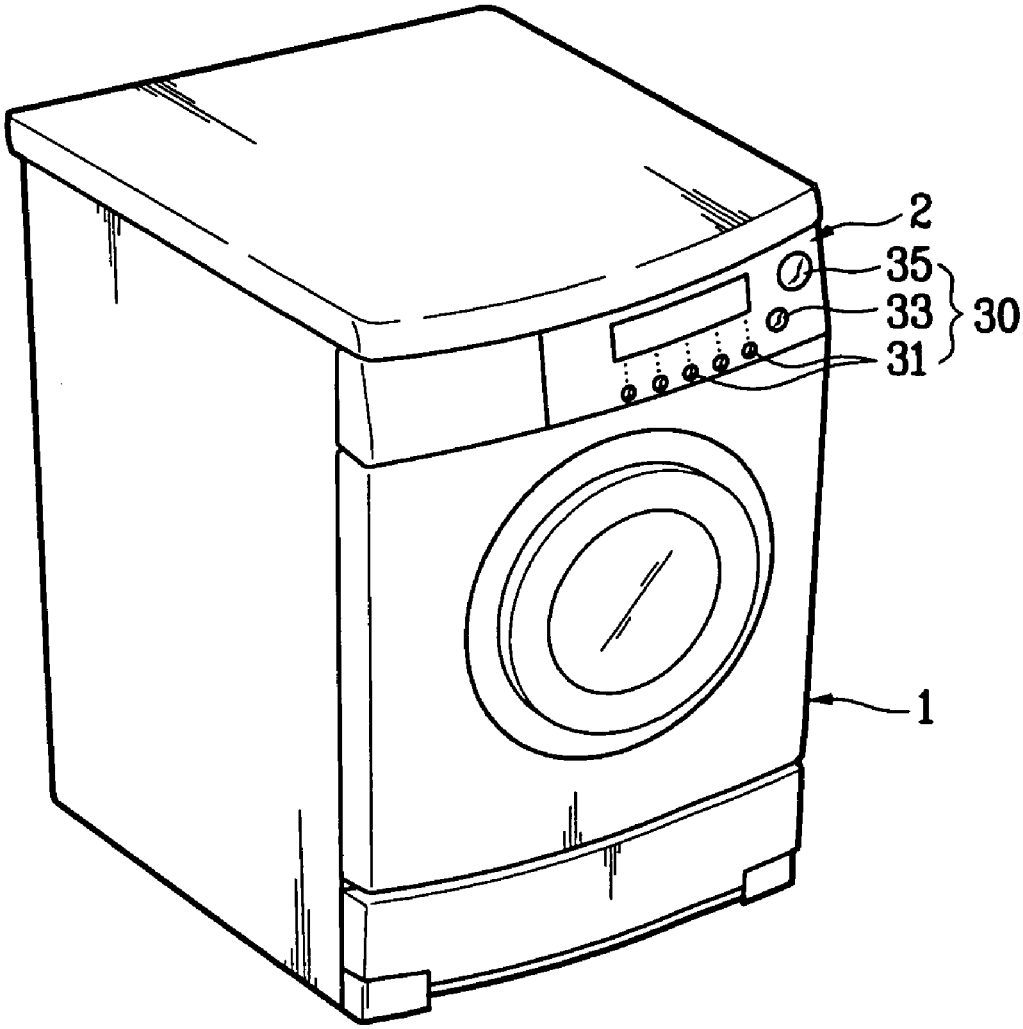
FIG. 1 illustrates a perspective view showing a conventional washing machine.
Figure 2:
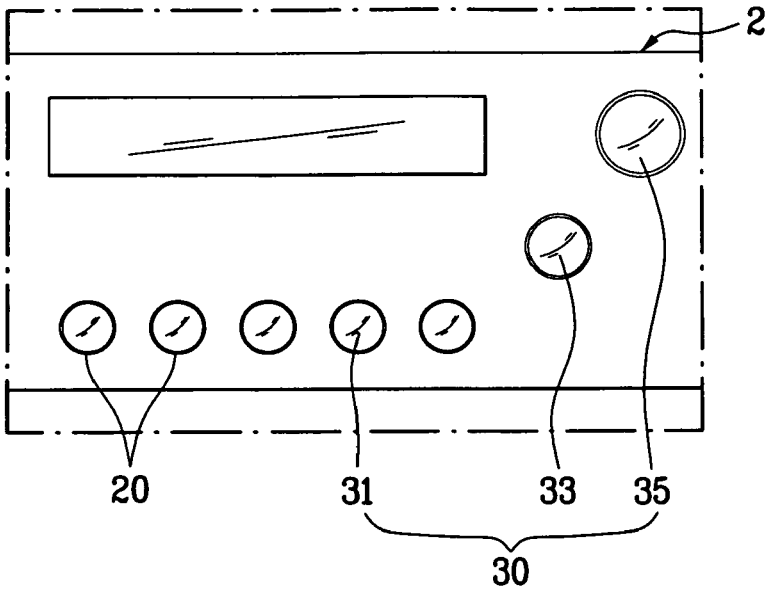
FIG. 2 illustrates a front view showing a control panel of FIG. 1.
Figure 3:
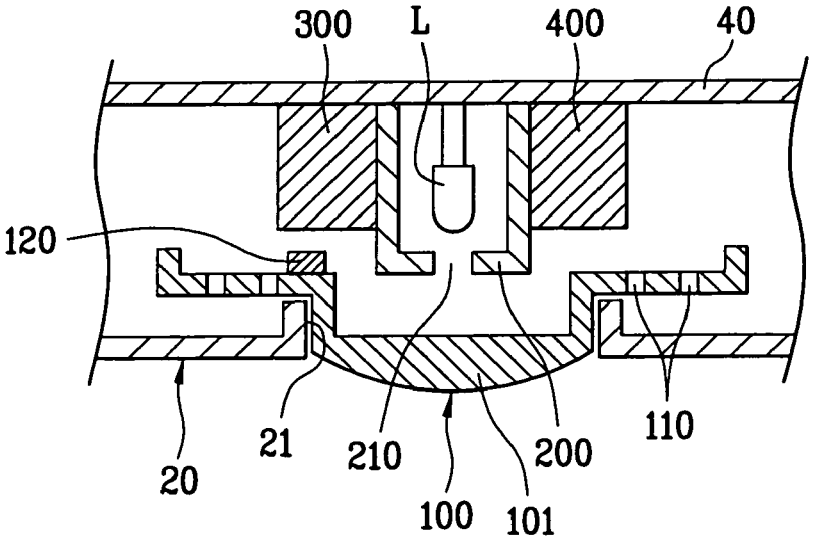
FIG. 3 illustrates a cross-sectional view showing a control panel in accordance with a first embodiment of the present invention.

Hereinafter, a control panel in accordance with each embodiment of the present invention is described in detail referring to FIGS. 3 to 12. FIG. 3 illustrates a cross-sectional view showing a control panel in accordance with a first embodiment of the present invention. As illustrated in FIG. 3, the control panel in accordance with the present invention includes an LED (Light Emitting Diode, L), a switch 300, a control panel 20, and an elastic button 100.

In this case, at least one of the LED (L) connected to a circuit board 40 emits light selectively. The LED is an electric device for emitting very bright light although is in a relatively small size. The LED is widely used owing to a development of recent study, the LED using a luminous phenomenon generated when a voltage is applied to a semiconductor. In comparison to a general light sources, the LED is relatively small, has a long life, and needs less electricity because electric energies are directly changed into light energies. Luminous efficiency is higher, large output is obtained at a low electric current, reply speed is fast, and light output is easily controlled through controlling electric current.

Meanwhile, the switch 300 is connected with the circuit board 40 and provided adjacent to the LED (L) for controlling the home appliance. The control panel 20 includes at least one first hole 21 through which the light emitted from the LED (L) is passed.

In addition, at least one the elastic button 100 is provided at an edge of the first hole 21 and selectively comes into contact with the switch 300 by a user pressing the button. Accordingly, when the user presses the button 100, the elastic button 100 comes into contact with the switch 300 and thus the power supply to or the operation of the home appliance is controlled according to the function of the switch.

In this case, the assembly further includes a supporter 200 having at least one protecting member provided at a main frame. In this instance, the protecting member is provided at the main frame so as to insert the LED therein. The protecting member is formed in a cylindrical shape and includes a second hole 210 formed toward the control panel 20. Therefore, the light emitted from the LED (L) is transmitted to a front side thereof through the second hole 210.

As illustrated in FIG. 3, the supporter 200 provided adjacent to a side of the LED (L) supports a predetermined space in which the LED (L) is located between the circuit board 40 and the control panel 20. Therefore, the LED is supported owing to the supporter 200.

Figure 4:
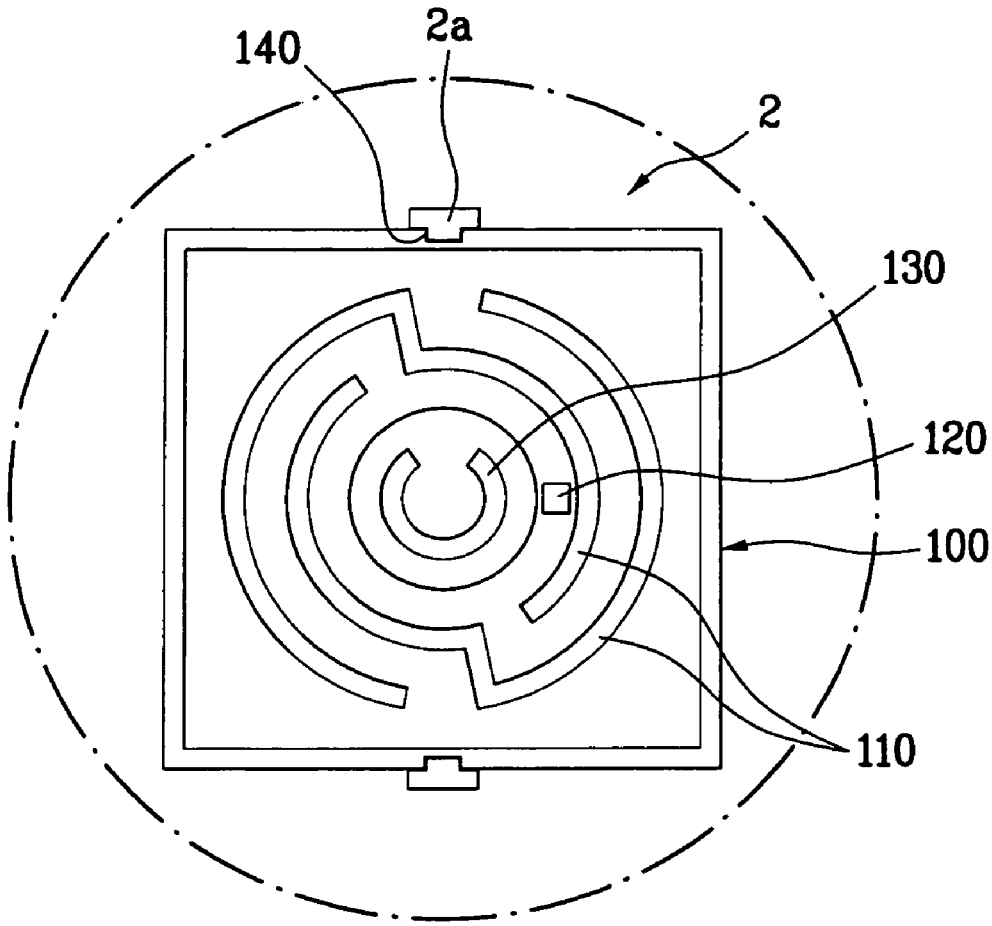
FIG. 4 illustrates a floor plan of an elastic button in accordance with the present invention.

FIG. 4 illustrates a floor plan of an elastic button in accordance with the present invention. As illustrated in FIG. 4, the elastic button 100 includes a pressing member 130 and an elastic supporting member 110. In this case, the pressing member 130 includes a first light-transmitting member 131 through which light emitted from the LED (L) is transmitted, and the elastic supporting member 110 is extended outward from the edge of the pressing member 130 and coupled with the edge of the first hole 21.

A plurality of thin holes 110*a* formed in a 'U' shape is provided at the elastic supporting member 110 for increasing elasticity. The plurality of holes 110*a* is at predetermined intervals from each other and has a parallel portion with increased elasticity. In other words, the parallel portion has a relatively long length and a small width, thereby increasing elasticity.

A structure of the elastic button 100 fixed on the control panel 20 is described as follows. As illustrated in FIG. 4, a hook 2*a* is provided on an inside edge of the first hole 21 formed at the control panel, and the hook 2*a* is snap fitted in a fixing groove 140 formed in an edge of the elastic button 100. In this case, an end of the hook 2*a* is inserted into the fixing groove 140 and fixed therein. Therefore, the elastic button 100 is more easily assembled to the control panel 20.

Meanwhile, referring to FIGS. 3 and 4, at a lower surface of the elastic button 100, a protrusion 120 selectively coming into contact with the switch 300 is provided. It is desirable that the protrusion 120 includes a conductor. The protrusion 120 may take a role of a medium for passing an electric signal for operating such home appliance as a washing machine during contact with the switch 300. Meanwhile, the protrusion 120 is configured to be able to operate the switch 300 by pressurization without including the electric conductor.

A stopper 400 is provided at adjacent to the switch 300 for maintaining the balance of the elastic button when the elastic button is in contact with the switch.

The pressed button 100 is restrained by the switch 300 and asymmetrically declined because the switch 300 is provided at a side of the LED (L). For preventing this, it is desirable that a stopper 400 having almost the same height as that of the switch is provided at an outside of the LED (L). The elastic button 100 is symmetrically declined owing to the stopper 400, thereby preventing the elastic button from being damaged.

In case that the switch 300 is declined for a predetermined distance owing to the pressed elastic button 100, the stopper 400 has a lower height than that of the switch 300. In this case, it is desirable that the predetermined distance is as much as the declined length of the switch.

It is desirable that the switch 300 includes a contact switch operated by a contact with the elastic button 100. In other words, when the switch 300 is provided with the electric signal by the contact with the elastic button 100, the operation of the home appliance is controlled by the signal.

In the mean time, the assembly further includes an approach detecting sensor and a controlling means (not shown). In this case, the controlling means supplies electric power to the LED (L) when an approach of the user is detected by the approach detecting sensor. Accordingly, the LED (L) automatically emits light by the approach detecting sensor and the controlling means and the user is able to manipulate a desired button exactly without turning on the power at night.

Meanwhile, not only the buttons but also a plurality of display means are necessary on the control panel of the home appliance for displaying an operation state of the home appliance.

Figure 5:
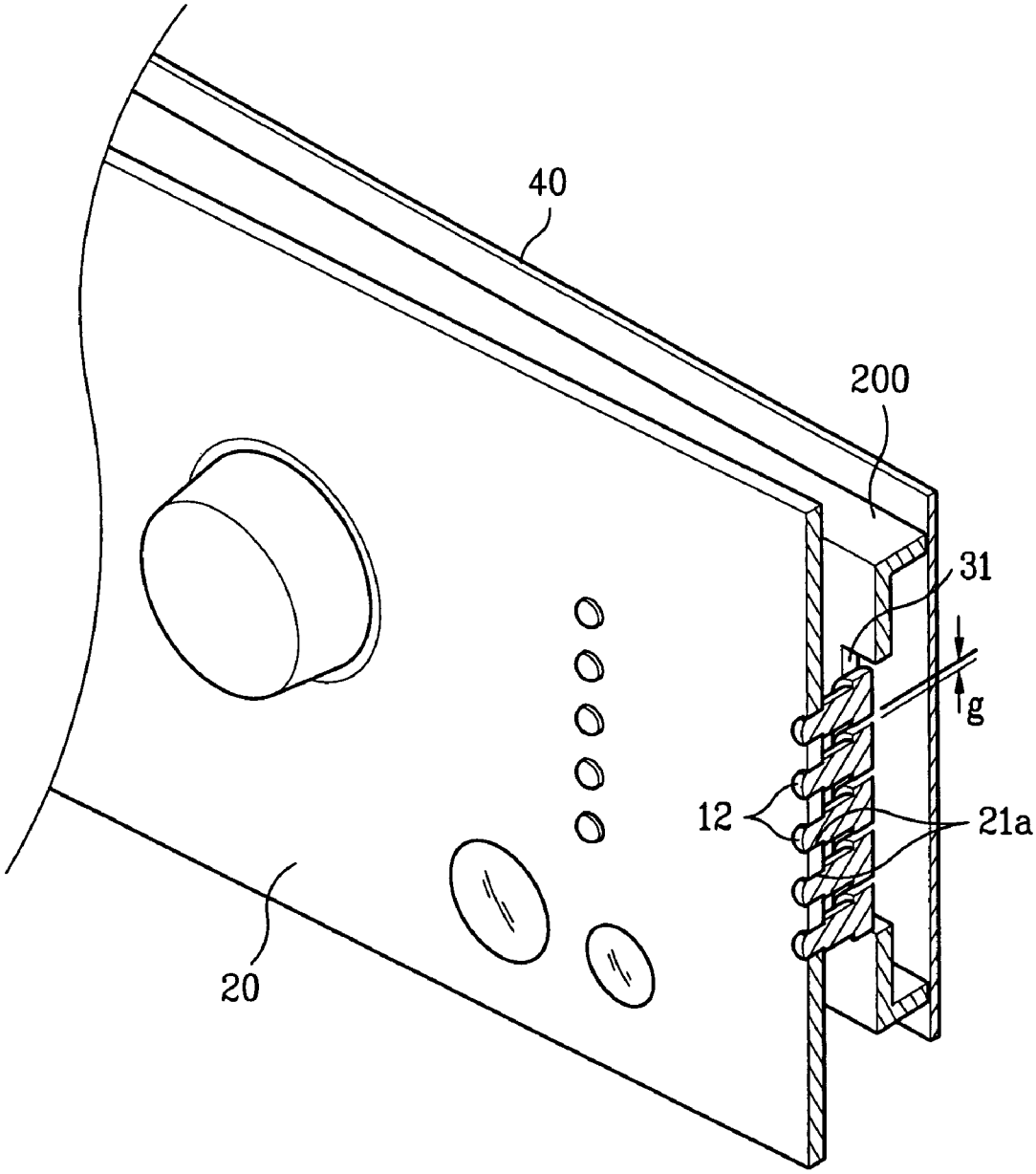
FIG. 5 illustrates a sectional perspective view of a control panel in accordance with a second embodiment of the present invention.
Figure 6:
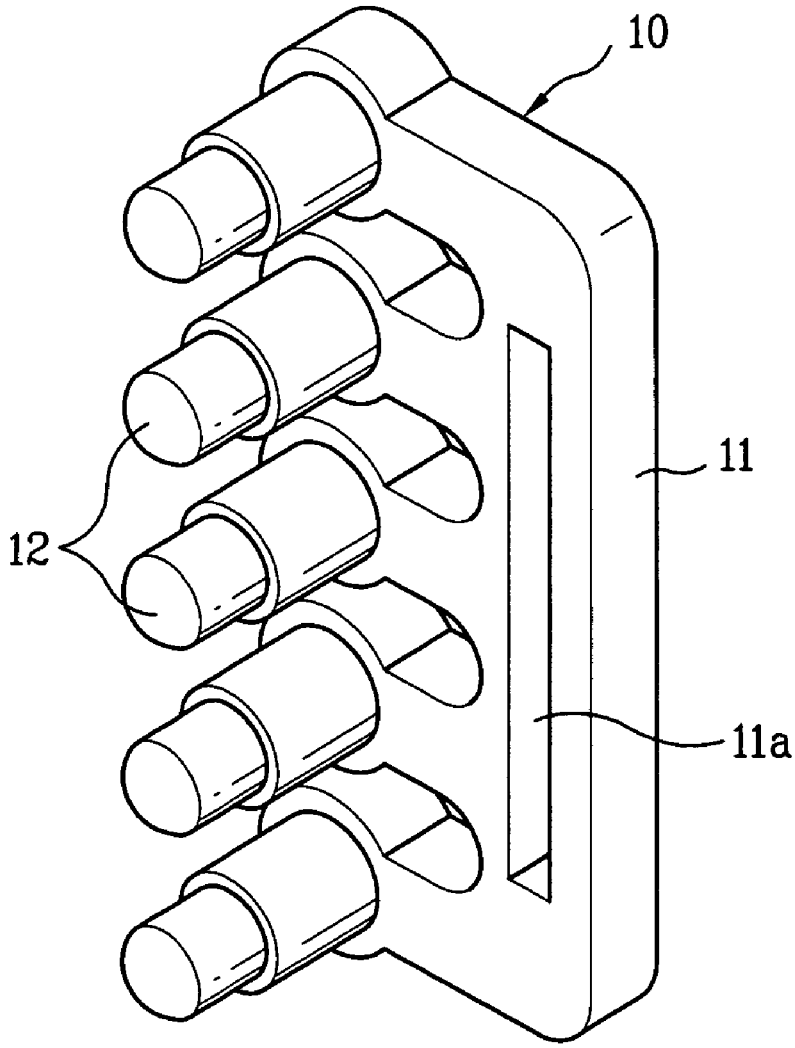
FIG. 6 illustrates a perspective view of an LED window in accordance with the present invention.

FIG. 5 illustrates a sectional perspective view of a control panel in accordance with a second embodiment of the present invention, and FIG. 6 illustrates a perspective view of an LED window in accordance with the present invention. As illustrated in FIGS. 5 and 6, at least auxiliary LED is provided at a lower part of the third hole 21*a* for displaying the operation state of the home appliance.

An LED window 10 is provided between the circuit board 40 and the control panel 20, the LED window 10 including a body 11 and a second light-transmitting member 12 for protecting the LED and transmitting emitted light. In this case, the second light-transmitting member 12 is branched from the body respectively so as to correspond to each of a plurality of the auxiliary LEDs, and an end thereof is inserted into the third hole 21*a*. Therefore, light emitted from each of the auxiliary LED is recognized from outside through the second transmitting member 12.

As illustrated in FIG. 5, each neighboring second transmitting member 12 is at predetermined intervals, and light emitted from one of the auxiliary LED is prevented from spreading to or streaming through another second light-transmitting member 12 corresponding to another auxiliary LED. Therefore, the operation state of the home appliance is exactly displayed.

Figure 7:
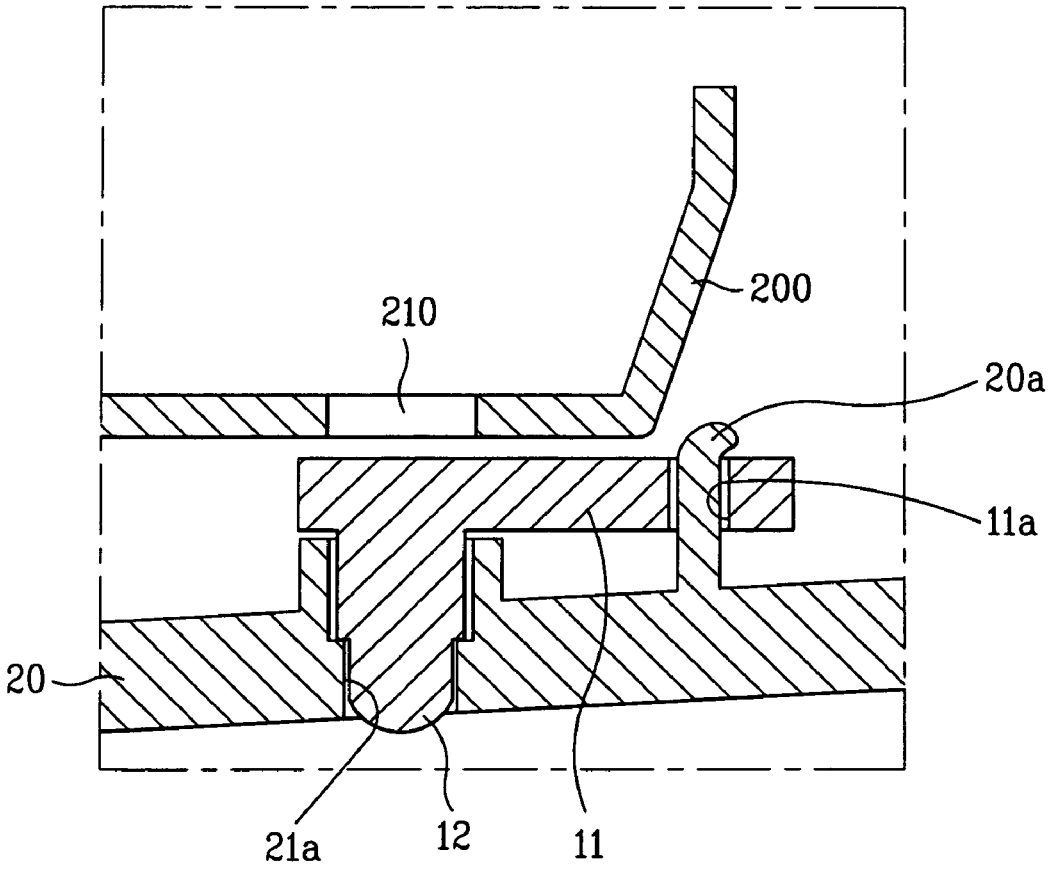
FIG. 7 illustrates a cross-sectional view of a control panel in accordance with a second embodiment of the present invention.

FIG. 7 illustrates a cross-sectional view showing a mounting structure of the LED window. As illustrated in FIG. 7, the LED window 10 is coupled with an inside surface of the control panel 20 by a coupling means. In other words, a projection rib is provided on an inside surface of the control panel and is coupled to a coupling hole formed on one side of the body. Therefore, the LED window 10 is more stably fixed thereon, thereby increasing reliability of the home appliance.

Figure 8:
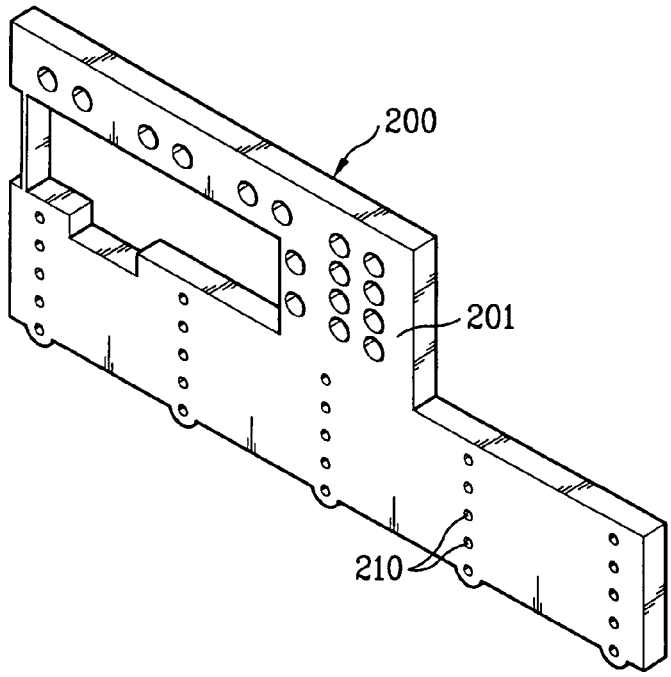
FIG. 8 illustrates a front perspective view of a supporter in accordance with the present invention.
Figure 9:
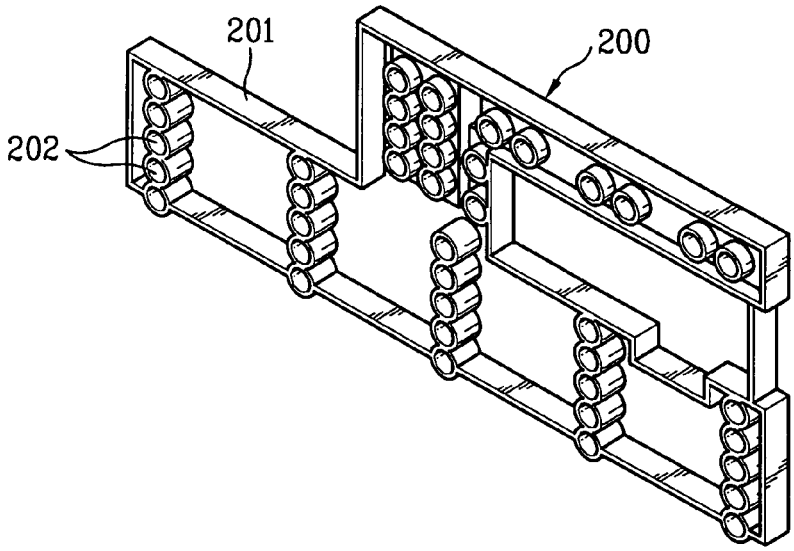
FIG. 9 illustrates a rear perspective view of a supporter in accordance with the present invention.

In the mean time, it is desirable that a supporter 200 is provided at a lower part of the LED window 10. In this case, the supporter 200 is provided between the circuit board 40 and the control panel 20 for protecting the LED. FIG. 8 illustrates a front view of a supporter and FIG. 9 illustrates a rear view of the supporter in accordance with the present invention. As illustrated in FIG. 8, the supporter 200 includes a main frame 201 and at least one protecting member 202 formed at the main frame 201.

In this case, the protecting member 202 is provided at the main frame 201, corresponding to the mounting location of the LED. The protecting member 202 is formed in a cylindrical shape and a second hole 210 is formed thereof toward the control panel 20.

Figure 10:
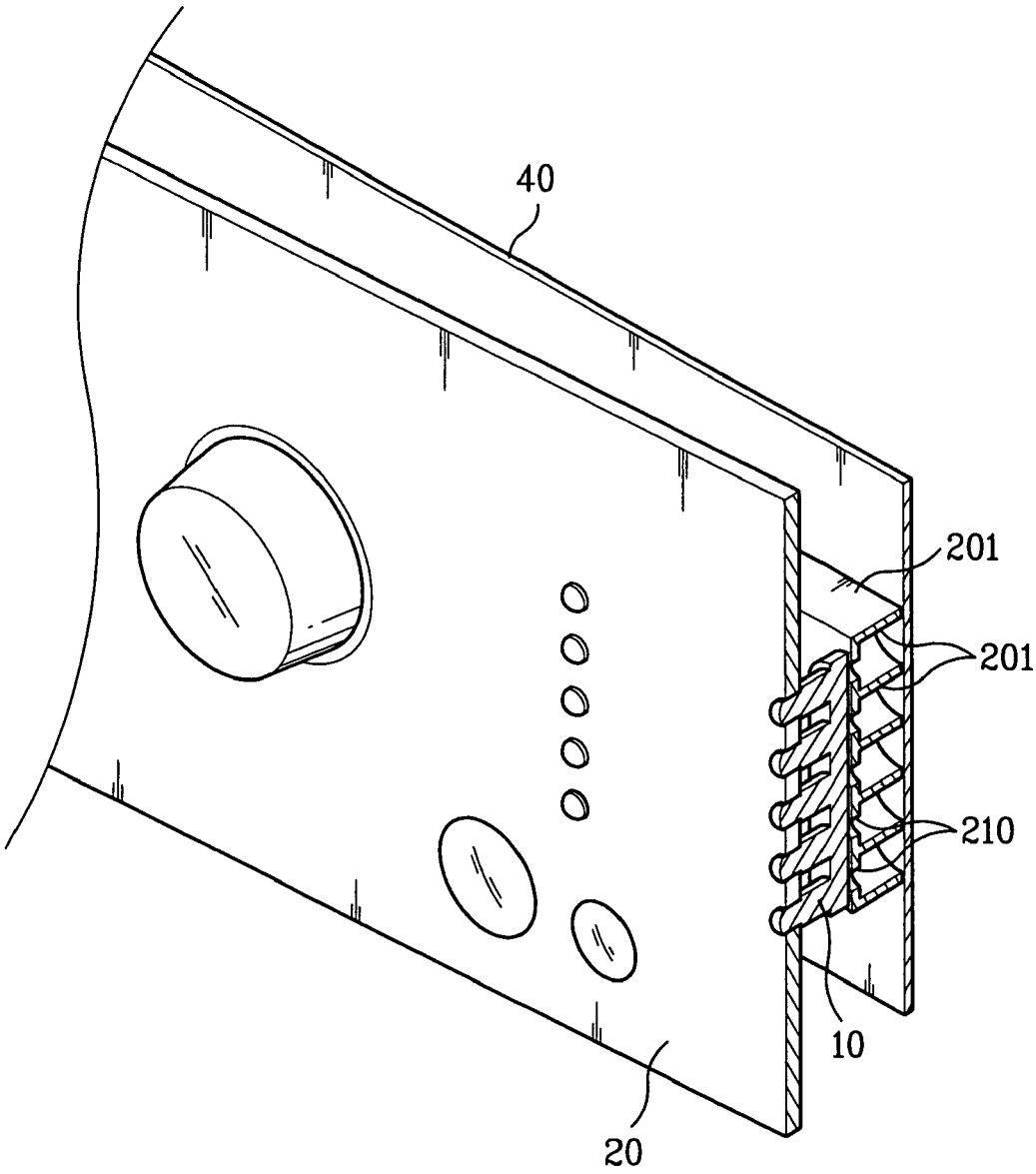
FIG. 10 illustrates a sectional perspective view of a control panel in accordance with the present invention.

FIG. 10 illustrates a cutaway perspective view of a control panel in accordance with the present invention. As illustrated in FIG. 10, a supporter 200 is provided in front of the circuit board 40 the LED is provided thereto. A plurality of protecting members 202 formed in the cylindrical shape is provided at the supporter 202, and the LED is inserted into the protecting member 202. It is desirable that the LED window is further provided between the supporter 200 and the control panel 20.

Figure 11:
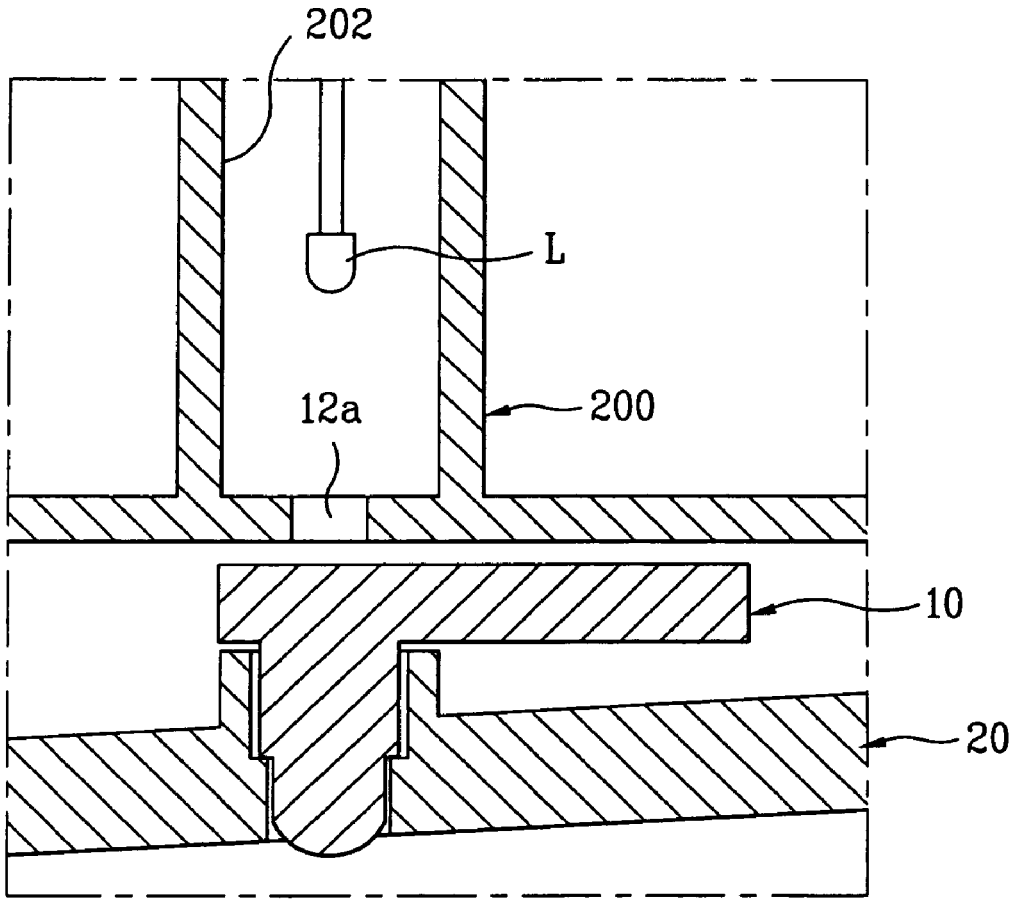
FIG. 11 illustrates a cross-sectional view of a control panel in accordance with the present invention.
Figure 12:
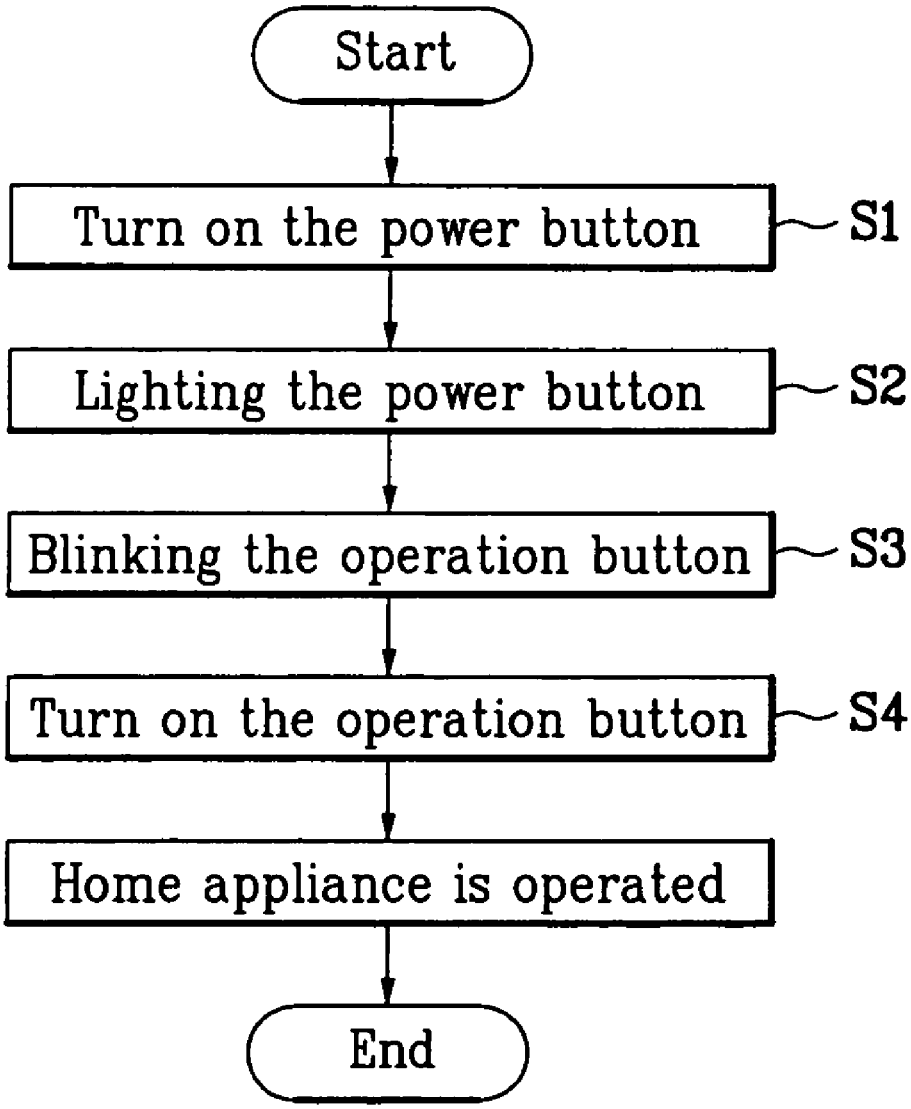
FIG. 12 illustrates a flow diagram related to a method for controlling the control panel in accordance with the present invention.

FIG. 11 illustrates a cross-sectional view of a control panel in accordance with the present invention. As illustrated in FIG. 11, the supporter 200 protects the LED (L). In this case, a plurality of protecting members 202 having the LED inserted therein is provided at the main frame 201, and a second hole 201 is provided in front of the protecting member 202 for transmitting light emitted from the LED. The second hole 210 is formed in a small size for protecting light from spreading through. Therefore, light emitted from one of the LEDs is protected from spreading to a location of another adjacent LED owing to the protecting member.

The light transmitted through the LED window 10 is recognized from outside through the first hole 21. Accordingly, the user can acknowledge a location of the button or the operation state of the home appliance.

Meanwhile, the elastic button 100 above mentioned may be provided between the supporter 200 and the control panel 20 instead of the LED window 10. In this case, the switches are provided at a side of the supporter 200 having the LED inserted therein, and the elastic buttons are provided at the edge of the first hole 21 formed on the control panel.

The user is able to understand location thereof because light emitted from the LED is transmitted through the elastic button. Accordingly, the user is able to press the elastic button exactly, and power supply or operation is controlled according to each button. The method for controlling the control panel in accordance with the present invention is described as follows.

The control panel in accordance with the present invention enables more easily manipulating the button by light emitted from a plurality of the LEDs (L). In this case, the buttons include elastic buttons connected to the control panel, and the controlling member controls a power source supplied to the LEDs according to a manipulation of the buttons.

Therefore, since the operation of the home appliance and the power source supplied to the LED is controlled, the LED is selectively turned on, blinked, or turned off. The method for controlling the control panel assembly in accordance with the present invention is related to a method for controlling a power button and an operation button provided to the home appliance. In this case, the operation button includes a pause function.

First of all, a first step of pressing the power button is performed for supplying power source to the home appliance so as to use the home appliance. Then, a second step of automatically lighting the power button by the controlling means is performed. Next, for indicating a button to be pressed by the user, a third step of blinking the operation button is performed, and a fourth step of pressing the operation button is performed for automatically operating the home appliance via the controlling member.

As aforementioned, the present invention provides a convenience of use by indicating which button the user need to press after the power source is supplied to the home appliance. In the fourth step, it is desirable that both the power button and the operation button are turned on or off because the home appliance is operated for a predetermined time after the operation is commanded to be performed, and then the buttons are turned on or off simultaneously.

Meanwhile, in the fourth step, the power button may be turned off and the operation button may be turned on in a case of indicating that the home appliance is in the operation. In other words, in a case of a home appliance operated without making any noise or vibration, it is impossible to know whether the home appliance is in operation or not. Therefore, it is desirable that each light of the buttons functions differently.

It is also desirable that the power is automatically turned on by an approach of the user because it is hard to press exactly the power of the home appliance at night. For solving this matter, in the first step, the approach detecting sensor provided at the home appliance detects the approach of the user so as to automatically supply power source thereto. Then, the second step is orderly performed after the power button is turned on.

The control panel in accordance with the present invention as aforementioned has effects as follows. First, the user can see the exact location of the button even at night by employing the LED to the buttons for controlling the home appliance. Second, indicating a point of an operation of the button in time through the LED enables the user to operate the home appliance more conveniently. Third, since the light-transmitting members of the LED window is branched from the body, corresponding to each of the LED, light emitted from one LED is prevented from spreading to another transmitting member. Therefore, the light is exactly distinguished outside. Fourth, since the LED window is stably coupled with the control panel by the coupling means, the reliability of the product is in creased. Fifth, since a protecting member having the LED inserted therein is provided to the supporter and a second hole is provided to the protecting member, light emitted from the LED is prevented from spreading to others around thereof. Therefore, the user can understand outside the operation state exactly.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A control panel assembly comprising:

at least one LED connected to a circuit board for selectively emitting light;

an LED window provided in front of the LED for transmitting therethrough the light emitted from the LED;

a control panel provided in front of the LED and having at least one first hole; and a supporter provided between the circuit board and the control panel for protecting the LED, wherein the supporter comprises a main frame; and at least one protecting member having a second hole toward the control panel and provided in the main frame for inserting the LED therein.

2. The control panel assembly as claimed in claim 1, wherein the LED window comprises:

a body; and a plurality of second light-transmitting members branched from the body respectively so as to correspond to each of a plurality of the auxiliary LEDs.

3. The control panel assembly as claimed in claim 2, wherein the second light-transmitting members are provided at predetermined intervals from each other.

4. The control panel assembly as claimed in claim 2, wherein the second light-transmitting member has a display member forwardly projected, and the display member is inserted into the first hole.

5. The control panel assembly as claimed in claim 2, wherein a projection rib is provided on an inside surface of the control panel, and the projection rib is coupled to a coupling hole formed at one side of the body.

6. The control panel assembly as claimed in claim 1, wherein the protecting member is formed in a cylindrical shape.

7. The control panel assembly as claimed in claim 1, further comprising:

an approach detecting sensor; and control means for selectively supplying electric power to the LED when the sensor detects an approach of the user.

8. The control panel assembly as claimed in claim 1, further comprising:

a switch connected to the circuit board and provided at a side of the supporter for controlling a home appliance; and at least one elastic button coupled with an edge of the first hole for selectively coming into contact with the switch in response to a user pressing the button, wherein the elastic member comprises a pushing member including a first light-transmitting part for transmitting therethrough light emitted from the LED.

* * * * *